US008020664B2

(12) United States Patent
Cornet et al.

(10) Patent No.: US 8,020,664 B2
(45) Date of Patent: Sep. 20, 2011

(54) ISOLATION VALVE FOR THE OIL CIRCUIT OF AN AIRPLANE ENGINE

(75) Inventors: Albert Cornet, Verviers (BE); Marc Mon Fort, Jalhay (BE)

(73) Assignee: Techspace Aero S.A. (BE)

( * ) Notice: Subject to any disclaimer, the term of this patent is extended or adjusted under 35 U.S.C. 154(b) by 802 days.

(21) Appl. No.: 11/958,021

(22) Filed: Dec. 17, 2007

(65) Prior Publication Data

US 2008/0264726 A1 Oct. 30, 2008

(30) Foreign Application Priority Data

Dec. 21, 2006 (EP) ..... 06447130

(51) Int. Cl.
*F01D 25/18* (2006.01)

(52) U.S. Cl. ..... 184/6.11; 60/39.08
(58) Field of Classification Search ..... 60/39.08; 184/6.11
See application file for complete search history.

(56) References Cited

U.S. PATENT DOCUMENTS

| | | | | |
|---|---|---|---|---|
| 2,666,490 | A * | 1/1954 | Richmond | 416/47 |
| 2,688,229 | A * | 9/1954 | Lee, II | 60/39.281 |
| 4,170,873 | A | 10/1979 | Milo | |
| 4,452,037 | A * | 6/1984 | Waddington et al. | 60/39.08 |
| 4,531,694 | A * | 7/1985 | Soloy | 244/54 |
| 4,887,424 | A * | 12/1989 | Geidel et al. | 60/39.08 |
| 7,681,402 | B2 * | 3/2010 | Champion et al. | 60/779 |

FOREIGN PATENT DOCUMENTS

| | | |
|---|---|---|
| EP | 1 510 658 A2 | 3/2005 |
| EP | 1 510 658 A3 | 1/2008 |

* cited by examiner

*Primary Examiner* — Thomas J Brahan
(74) *Attorney, Agent, or Firm* — Reinhart Boerner Van Deuren P.C.

(57) ABSTRACT

The present invention relates to a turbomachine comprising an air compressor (3) and a lubrication circuit with an oil tank (1), said oil tank (1) being possibly isolated from the rest of the lubrication circuit (4,4A; 6,6A) by means of an isolation valve (7), wherein the isolation valve (7) is configured so as to:

operate, i.e. to close and open respectively as the engine (2) stops and starts;
remain open when the engine (2) is running;
remain closed when the engine (2) is stopped.

6 Claims, 1 Drawing Sheet

ISOLATION VALVE FOR THE OIL CIRCUIT OF AN AIRPLANE ENGINE

CROSS REFERENCE TO RELATED PATENT APPLICATION

This patent application claims the benefit of European Patent Application No. 06447130.3, filed Dec. 21, 2006.

FIELD OF THE INVENTION

The present invention relates to a shut-off and isolation valve positioned at the outlet of the oil tank of an airplane engine and to its pneumatic control system.

The application area of the present invention is that of turbomachines in general, and in particular of those, like turbo-props, liable to come to a complete stop or to a very low residual speed of the rotating shaft after the engine is stopped during the flight and with the exception of those provided with an electric starter.

STATE OF THE ART

In airplane engines, valves are known that allow to shut off the oil circuit when the engine stops in order to prevent leaks through the pump (anti-siphon function). Valves are also known that allow to shut off the oil circuit when an engine is accidentally stopped during the flight in order to protect the equipment in the event of fire in the engine.

Indeed, in a turbo-prop, when the engine is stopped during the flight, the propeller blades are "feathered" so as to present the smallest possible surface area to the relative wind and to reduce the drag caused by the rotation of the propeller. The combination of the feathering of the propeller and the curved and narrower geometry of the air intake often leads to the total stop of the compressor shaft in contrast to the situation in most jet engines, in which residual rotation of the compressor is maintained given the speed of the airplane. In a turbo-prop, there is therefore no more oil circulation in the equipment after an engine is stopped during the flight.

In general, when adequate oil circulation is maintained in the lubrication circuit equipment in the event of an engine stopping during the flight, it is not necessary to provide specific fire protection. However, when the oil circulation is not maintained, it is necessary to provide either a protection for each piece of equipment allowing to withstand a fire or a valve for shutting off the oil supply coming from the tank so as to restrict the amount of oil available for combustion.

In the turbo-props as in the state of the art, a shut-off valve is known that serves to shut off and isolate the oil circuit and is in the form of an electric control valve. However, the function of such a valve is only of preventing fire but not of preventing leaks, this latter function being provided by other devices. The presence of a valve of an anti-siphon type for shutting off the oil circuit is in fact also required during normal stopping of the engine, its closure preventing the oil tank from emptying through the circuit to the lowest points of the engine.

Moreover, a valve of the above-mentioned type not only requires a source of electrical power but also a control logic at the level of the engine or of the airplane. In fact, the control computer is overloaded in some airplanes or even nonexistent where control is servomechanical.

AIMS OF THE INVENTION

The present invention aims to provide a solution that allows to overcome the drawbacks of the state of the art.

The invention aims to provide a single isolation valve ensuring the double function of fire prevention and anti-siphon, operated with every stop and start of the engine, following a normal stop or a stop of the engine during the flight.

The invention aims in particular to provide a control device that allows to use the compressed air of the engine both for the control power and for the start/stop signal.

Main Characteristic Elements of the Invention

The present invention relates to a turbomachine comprising an air compressor and a lubrication circuit with an oil tank, said oil tank being possibly isolated from the rest of the lubrication circuit by means of an isolation valve, wherein the isolation valve is configured so as to:

- operate, i.e. to close and open as the engine stops or starts respectively, whatever the reason, whether it be normal or accidental;
- remain open when the engine is running;
- remain closed when the engine is stopped.

As an advantage, the isolation valve is pneumatically controlled and provided with a device allowing to automatically select as an operation the more highly compressed source of compressed air from two different sources.

According to a first preferred embodiment of the invention, the first source of pressure is the air pressure coming from the engine compressor.

According to a second preferred embodiment of the invention, the second source of pressure is the pneumatic control corresponding to a start signal of the engine, in particular the control air pressure of a pneumatic starter of the engine.

As a particular advantage, the isolation valve is controlled by either two sources of compressed air, via a shuttle valve whose two intakes are connected to said two sources of compressed air respectively and whose outlet is connected to the isolation valve.

The isolation valve is preferably a flap valve provided with a bellows cylinder.

The invention is particularly appropriate for application when the turbomachine is a turbo-prop.

In this case, as in the invention, in a particularly advantageous manner the isolation valve allows to isolate on the one hand the oil tank from the rest of the lubrication circuit of the engine and on the other from the rest of the lubrication circuit of the gearbox of the turbo-prop.

DESCRIPTION OF A PREFERRED EMBODIMENT OF THE INVENTION

Figure 1:
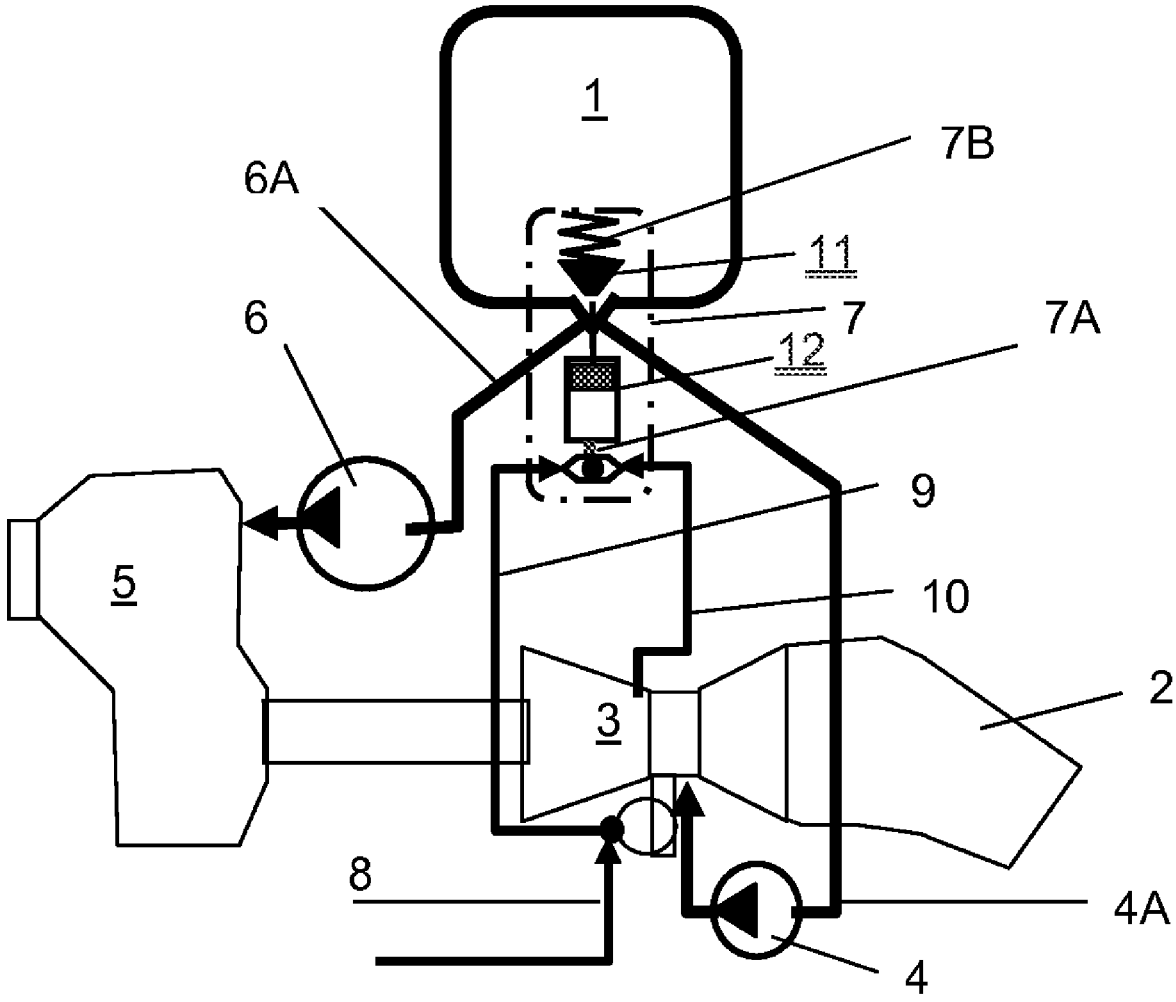
FIG. 1 represents a schematic view of the control system of a pneumatic valve for shutting off the outlet of an oil tank in an airplane engine, as in the present invention.

The system proposed as in the invention and shown in FIG. 1 uses pneumatic power, for example that generated by the compressor 3 or that supplied to the starter 8, to open an isolation valve 7 for the oil tank 1, shut at rest, ensuring both the protection of the oil circuit in the event of fire and an anti-siphon function. The isolation valve 7 is advantageously a flap valve connected to a bellows cylinder, which guarantees its seal whilst minimising friction.

The valve 7 is operated either by the air pressure supplied to the starter 9 or by that of the compressor 10, depending on the position of a built-in shuttle valve 7A, which allows to automatically select the source of higher pressure. This shuttle valve has two intakes connected in the present case to the air pressure supplied to the starter and that of the compressor respectively and an outlet connected to the isolation valve 7. A ball ensures the shuttle motion between the two seats corresponding to the two intakes, the seat corresponding to the higher pressure being free.

Thus, the isolation valve 7 is open either when the engine is running or when it is started. It is closed at rest or when there is a drop in engine pressure during the flight. As an advantage, the shuttle valve 7A may be adjusted without a taper or with a taper allowing to pass the engine start-up transients.

The isolation valve 7 thus closes under the action of a return spring 7B as soon as there is no more air pressure.

As shown in the example of FIG. 1, once the isolation valve is open, the oil tank is connected to the equipment of the lubrication circuit of the engine 2 via the channel 4A and pump 4 and, via the channel 6A and pump 6, to the power gearbox 5 which, in the case shown here, has its own lubrication circuit.

The present invention has the following advantages:

presence of a single valve for fire protection and for anti-siphon valve, hence a benefit in weight and cost given the removal of the fire protection (for example made of special steels) and of the separate anti-siphon valve;

no electronic control logic required;

no electric energy required;

use of pneumatic control both as a power source and as a start/stop signal.

The invention claimed is:

1. A turbomachine comprising an air compressor (3) and a lubrication-circuit with an oil tank (1) and an isolation valve (7) that allows to isolate the oil tank (1) from the rest of the lubrication circuit (4, 4A; 6, 6A), wherein the isolation valve is configured so as to:

operate to close and open respectively as the engine (2) stops and starts;

remain open when the engine (2) is running; and remain closed when the engine (2) is stopped;

wherein said isolation valve (7) is pneumatically controlled; and wherein said isolation valve (7) is provided with a device (7A) allowing to automatically select as an operation the more highly compressed source of compressed air from two different sources (9,10).

2. The turbomachine of claim 1, wherein the first source of pressure (10) is the air pressure coming from the engine compressor (3).

3. The turbomachine of claim 1, wherein the second source of pressure (9) is the pneumatic control corresponding to a start signal (8) of a pneumatic engine starter.

4. The turbomachine of claim 1, wherein the isolation valve (7) is controlled by said two sources of compressed air (9,10) via a shuttle valve (7A), whose two intakes are connected to said two sources of compressed air (9,10) respectively and whose outlet is connected to the isolation valve (7).

5. The turbomachine of claim 1, wherein the isolation valve (7) is a flap valve (11) provided with a bellows cylinder (12).

6. The turbomachine of claim 1, wherein the isolation valve (7) allows to isolate the oil tank (1) for one thing from the rest of the lubrication circuit (4,4A) of the engine (2) and for another from the rest of the lubrication circuit (6,6A) of a turbo-prop gearbox (5).

* * * * *